US005689237A

United States Patent [19]

Sasagawa et al.

[11] Patent Number: 5,689,237

[45] Date of Patent: Nov. 18, 1997

[54] ANTITHEFT SECURITY TAG AND ELECTRONIC ARTICLE SURVEILLANCE SECURITY SYSTEM

[75] Inventors: Shinichi Sasagawa; Seishi Namioka; Nobuyuki Ichimiya; Shin Kinouchi, all of Miyagi-ken, Japan

[73] Assignee: Alps Electric Co., Ltd., Tokyo, Japan

[21] Appl. No.: 609,811

[22] Filed: Mar. 1, 1996

[30] Foreign Application Priority Data

Oct. 3, 1995 [JP] Japan ..... 7-051214

[51] Int. Cl.[6] ..... G08B 13/14

[52] U.S. Cl. ..... 340/568; 340/650; 340/652

[58] Field of Search ..... 340/568, 652, 340/650

[56] References Cited

U.S. PATENT DOCUMENTS 3,253,270 5/1966 Downer ..... 340/568
4,573,042 2/1986 Boyd et al. ..... 340/539
4,746,909 5/1988 Israel et al. ..... 340/568
5,099,228 3/1992 Israel et al. ..... 340/572

*Primary Examiner*—Glen Swann
*Attorney, Agent, or Firm*—Guy W. Shoup; Patrick T. Bever

[57] ABSTRACT

An antitheft security tag is used in combination with an article surveillance security system. The antitheft security tag comprises a tagging part to be tagged to an article, formed by looping a two-core cable having two insulated copper wires or the like, a connecting part formed out of a cable, to be connected to the article surveillance security system, a joining part for joining the tagging part to the connecting part, and a resistor contained in the joining part and connected in series to the wires of the two-core cable forming the tagging loop. One end of the connecting part to be connected to the article surveillance security system is provided with a connector to be connected to the article surveillance security system. The article surveillance security system monitors the resistance of the antitheft security tag for article surveillance and detects unauthorized tampering with the antitheft security tag through the detection of a change in the resistance of the antitheft security tag.

12 Claims, 2 Drawing Sheets

ANTITHEFT SECURITY TAG AND ELECTRONIC ARTICLE SURVEILLANCE SECURITY SYSTEM

BACKGROUND OF THE INVENTION

1. Field of the Invention

The present invention relates to an antitheft security tag and an electronic article surveillance security system and, more particularly, to an antitheft security tag to be attached to an article placed on a display shelf of a store or the like and to be used in combination with an electronic article surveillance security system capable of detecting the unauthorized removal or the severance of the antitheft security tag through the detection of a change in the resistance of a wire forming the antitheft security tag, and an electronic article surveillance security system using the antitheft security tag.

2. Description of the Related Art

Generally, prior art article surveillance security systems use an antitheft security tag having a loop which is formed simply by looping a wire extending from the article surveillance security system and twined around an article. The article surveillance security system detects the severance of the wire forming the loop of the antitheft security tag or the separation of the antitheft security tag from the article surveillance security system, and then generates an alarm.

Since the loop of the prior art antitheft security tag is formed simply by looping the wire and is twined around an article, the article surveillance security system is unable to detect the separation of the antitheft security tag from the article when the antitheft security tag is separated from the article after directly short-circuiting a portion of the antitheft security tag near the article surveillance security system or short-circuiting the same with another wire.

Usually the respective resistances of the wire forming the loop of the antitheft security tag and a cable connecting the antitheft security tag to the article surveillance security system add up to a very small resistance on the order of several tens of milliohms. Therefore, a change in the resistance to be detected by the article surveillance security system is very small when the loop of the antitheft security tag is severed after short-circuiting a portion of the antitheft security tag near the article surveillance security system, and it is hardly possible to detect such a small change in the resistance.

Accordingly, the article surveillance security system using such an antitheft security tag is minimally effective in detecting the theft of an article.

SUMMARY OF THE INVENTION

Accordingly, it is an object of the present invention to provide an antitheft security tag to be used in combination with an article surveillance security system, capable of enabling the article surveillance security system to detect tampering with the loop of the antitheft security tag to steal an article to which the antitheft security tag is attached, and an article surveillance security system that uses such an antitheft security tag.

According to one aspect of the present invention, an antitheft security tag comprises a tagging part to be tagged to an article, formed by looping a two-core cable, a connecting part consisting of a cable for connecting the tagging part to an article surveillance security system, a joining part for joining the tagging part to the connecting part, and a resistor contained in the joining part and connected in series to the wires of the two-core cable forming the tagging loop. These components of the antitheft security tag are connected so as to form a single electrical loop.

According to another aspect of the present invention, an antitheft security tag comprises a tagging part to be tagged to an article, formed by looping a two-core cable having two distributed-resistance wires, a connecting part consisting of a cable for connecting the tagging part to an article surveillance security system, and a joining part for joining the tagging part to the connecting part. The free ends of the two distributed-resistance wires of the two-core cable are joined together in the joining part, and the components of the antitheft security tag are connected so as to form a single electrical loop.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
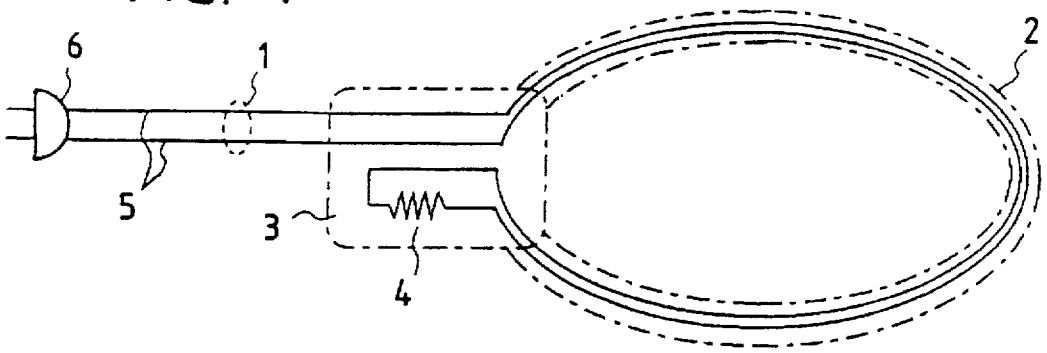
FIG. 1 is a schematic perspective view of an antitheft security tag in a first embodiment according to the present invention.
Figure 2A:
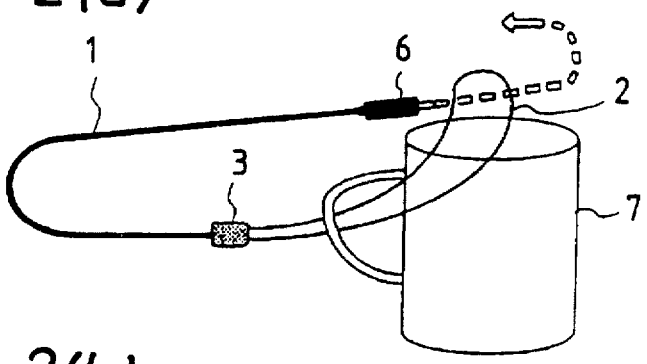
FIG. 2 is a pictorial view for assistance in explaining the use of the antitheft security tag of FIG. 1.
Figure 2B:
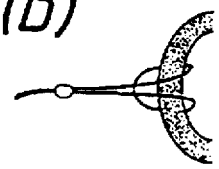

Referring to FIGS. 1 and 2, an antitheft security tag in a first embodiment according to the present invention comprises a connecting part 1, a tagging part 2 to be twined around an article 7, a joining part 3, a resistor 4 and a connector 6. The tagging part 2 is formed by looping a two-core cable having two insulated conductive wires 5 of copper or the like. The connecting part 1 to be connected to an article surveillance security system, not shown, is a two-core cable having two conductive wires 5. The connecting part 1 is joined to the tagging part 2 in the joining part 3, and the resistor 4 is connected in series to the conductive wires 5 of the two-core cable forming the tagging part 2. The connector 6 for connecting the antitheft security tag is connected to the free ends of the conductive wires 5 of the two-core cable forming the connecting part 1.

As best shown in FIG. 2, the looped tagging part 2 is tied to the article 7, and the connector 6 is connected to a relay, not shown, connected to the article surveillance security system. The article surveillance security system monitors the resistance of the antitheft security tag connected thereto to protect the article 7 from theft.

The antitheft security tag is a series circuit consisting of the conductive wires 5, and the resistor 4 connected in series to the conductive wires 5. When the resistance of the conductive wires 5, as compared with that of the resistor 4, is negligibly small, the connection of the antitheft security tag to the article surveillance security system is equivalent to the connection of the resistor 4 to the article surveillance security system.

Therefore, if the wire or wires 5 of the tagging part 2 are severed to steal the article 7, the resistor 4 is electrically disconnected from the article surveillance security system. The article surveillance security system takes the disconnection of the resistor 4 therefrom to be a sudden increase in the resistance of the antitheft security tag to infinity. Such a great change in the resistance of the antitheft security tag can be easily detected by the article surveillance security system.

When making an attempt to separate the antitheft security tag from the article 7 by short-circuiting portions of the conductive wires 5 of the tagging part 2 and severing a portion of the tagging part 2 extending beyond the short-circuited portions of the conductive wires 5, the conductive wires 5 of the tagging part 2 must be securely short-circuited, which is very difficult to accomplish without being noticed by a salesperson.

The resistor 4 connected in series to the conductive wires 5 in the joining part 3 may of any resistance, provided that the resistance of the antitheft security tag increases to infinity or drops to zero when the tagging part 2 is severed or separated from the article 7 or an unauthorized tampering, such as a short circuit, of the tagging part 2 attempted. However, the resistance of the resistor 4 should not be excessive small in view of suppressing power consumption and enabling the article surveillance security system to use an inexpensive detection circuit for detecting a change in the resistance of the antitheft security tag, and must not be excessively large in view of avoiding malfunction due to noise. From such a point of view, it is desirable that the resistance of the resistor 4 is in the range of about 1 kΩ to about 100 kΩ and an optimum resistance of the resistor 4 is about 10 kΩ.

As is obvious from the foregoing description, it is very difficult to short-circuit portions of the conductive wires 5 of the tagging part 2 formed by looping a two-core cable, in an attempt to separate the antitheft security tag from the article 7, and the resistance of the antitheft security tag changes greatly if the tagging part is tampered with, so that the article surveillance security system is able to ensure highly reliable article surveillance.

Although the first embodiment employs the two-core cable forming the connecting part 1 and the two-core cable forming the tagging part 2 different from each other in quality as shown in FIG. 2 to secure appropriate strength for the connecting part 1 and the tagging part 2, the connecting part 1 and the tagging part 2 may be formed out of two-core cables of the same quality.

Figure 3:
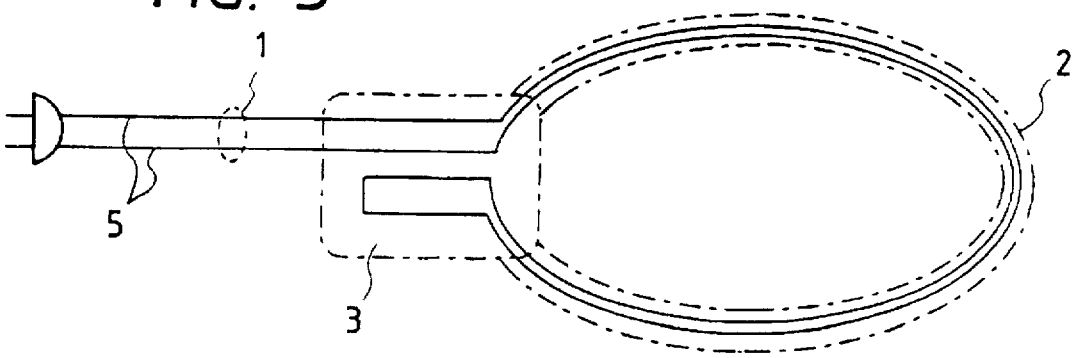
FIG. 3 is a schematic perspective view of an antitheft security tag in a second embodiment according to the present invention.

FIG. 3 shows an antitheft security tag in a second embodiment according to the present invention, in which parts like or corresponding to those shown in FIG. 1 are designated by the same reference numerals. Referring to FIG. 3, the antitheft security tag comprises a connecting part 1, a tagging part 2 and a joining part 3. One portion of a two-core cable having two distributed-resistance wires 5, such as carbon-fiber wires, is looped to form the tagging part 2, and the other portions of the two-core cable form the connecting part 1. The antitheft security tag in the second embodiment is entirely the same in construction as that in the first embodiment, except that, in the second embodiment, the free ends of the two distributed-resistance conductive wires 5 of the portion of the two-core cable forming the tagging part 2 are connected directly in the joining part 3.

The electric conductivity of carbon fibers is not as high as those of metals, and 1 mm diameter carbon fibers have resistivities in the range of several tens of ohms per centimeter to several kiloohms per centimeter. Recently highly flexible carbon fibers have been marketed, and such carbon fibers are suitable for forming the wires of two-core cables for forming the tagging part 2 of the antitheft security tag of the present invention. Nickel-chrome alloy wires, metal wires, have a high electrical resistivity and are suitable for use as the distributed-resistance wires 5 of the two-core cable for forming the tagging part 2 of the antitheft security tag of the present invention. The wires 5 of the two-core cable forming the tagging part 2 of the antitheft security tag in the second embodiment may be carbon-fiber wires or nickel-chrome alloy wires, and the resistance of the antitheft security tag is in the range of 100Ω to 1 MΩ.

The functions and effects of the antitheft security tag in the second embodiment are the same as those of the antitheft security tag in the first embodiment.

Only the looped tagging part 2 may be formed out of the two-core cable having the distributed-resistance wires 5, and the connecting part 1 may be formed out of a two-core cable having two low-resistance conductive wires, such as copper wires. When a plurality of antitheft security tags having connecting parts 1 of different lengths, formed out of a two-core cable having two low-resistance conductive wires, respectively, and tagging parts 2 of the substantially the same size each formed out of the two-core cable having the distributed-resistance wires 5 are connected to an article surveillance security system, the respective resistances of all the antitheft security tags are substantially the same, and hence the article surveillance security system may be provided with a resistance change detecting circuit of a simple circuit configuration.

Figure 4:
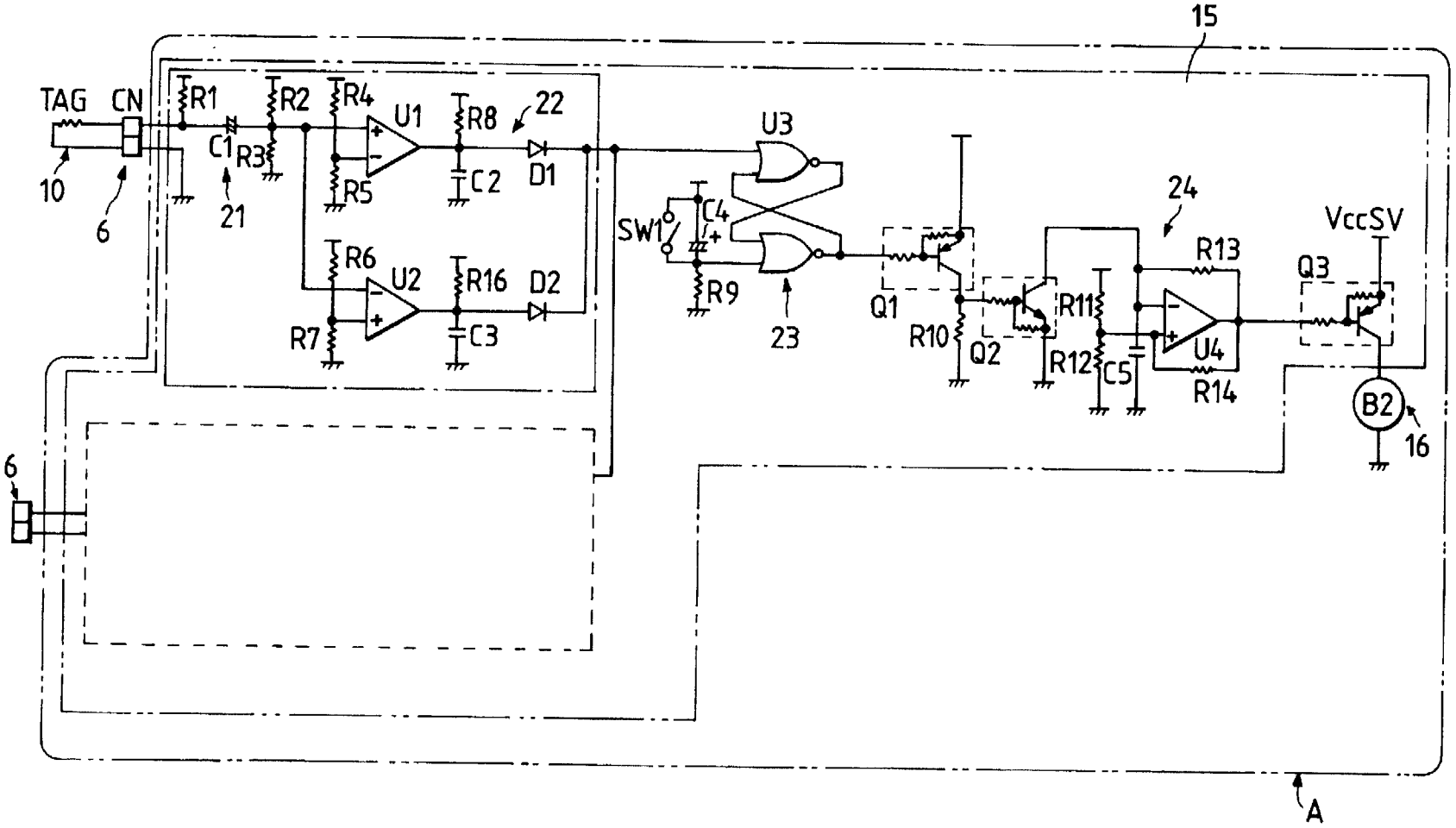
FIG. 4 is a circuit diagram of a resistance change detecting circuit included in an article surveillance security system to be used in combination with an antitheft security tag in accordance with the present invention.

FIG. 4 shows a resistance change detecting circuit included in an article surveillance security system A to be used in combination with the foregoing antitheft security tag in accordance with the present invention. Shown in FIG. 4 are the antitheft security tag 10, a controller 15, a buzzer 16, a differentiation circuit 21 comprising a capacitor C1 and resistors R2 and R3, an integrating circuit 22 comprising a resistor R8 and a capacitor C2, a latch circuit 23, and a rectangular pulse signal generator 24 comprising an operational amplifier U4, resistors R11, R12, R13 and R14 and a capacitor C5. As shown in FIG. 4, the two wires of the antitheft security tag 10 are connected through the connector 6 to the controller 15. One of the wires is connected to a ground GND and the other is connected through a resistor R1 to Vcc. A voltage divided by the resistor R1 and the resistance of the antitheft security tag 10 is applied to the differentiation circuit 21.

When the resistance of the antitheft security tag 10 increases due to damage caused to the wires, the wire or wires are broken or the antitheft security tag 10 is disconnected from the article surveillance security system A, the output voltage of the differentiation circuit 21 increases. If the output voltage of the differentiation circuit 21 increases beyond a threshold voltage for a comparator U1, the output of the comparator U1 goes high. Then, the output voltage of the integrating circuit 22 increases and, consequently, the latch circuit 23 connected through a diode D1 to the integrating circuit 22 is set. The integrating circuit 22 negates the effect of noise that continues for a time of or shorter than a predetermined time to prevent malfunction.

If the wires 5 are short-circuited in the connecting part 1 or the tagging part 2 of the antitheft security tag 10 (see FIGS. 1 and 3), the output voltage of the differentiation circuit 21 decreases. When the output voltage of the differentiation circuit 22 decreases below a threshold voltage for a comparator U2, the output of the comparator U2 goes high and the latch circuit 23 is set. Then, transistors Q1 and Q2 are turned off to actuate the rectangular pulse signal generating circuit 24. Consequently, a transistor Q3 is turned on and the buzzer 16 generates an alarm sound.

When a plurality of antitheft security tags 10 are to be connected to the article surveillance security system A, the article surveillance security system A is provided with a plurality of circuits identical with the circuit enclosed by alternate long and short dash line in FIG. 4 in a section enclosed by broken line for all the antitheft security tags 10, respectively. FIG. 4 shows a circuit configuration for two antitheft security tags 10 by way of example.

Since the buzzer 16 is actuated when the output of the differentiation circuit 21, i.e., the rate of change of the resistance of the antitheft security tag 10, exceeds a given value, no alarm sound is generated even if the resistance of the antitheft security tag 10 has changed with time by aging, the buzzer 16 is actuated only when the resistance of the antitheft security tag 10 changes sharply or when the antitheft security tag 10 is disconnected from the article surveillance security system A, and no problem arises even if the plurality of antitheft security tags 10 connected to the article surveillance security system A have different initial resistances, respectively, or different from a standard resistance.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. An antitheft security tag to be used in combination with an article surveillance security system, said antitheft security tag comprising;

a tagging part to be tagged to an article, formed by looping a two-core cable;

a connecting part formed out of a cable, to be connected to the article surveillance security system;

a joining part for joining the tagging part to the connecting part; and a resistor contained in the joining part and connected in series to the wires of the two-core cable forming the tagging loop, wherein said foregoing components are connected so as to form a single electrical loop.

2. An antitheft security tag according to claim 1, wherein the cable forming the connecting part is a two-core cable.

3. An antitheft security tag according to claim 1, wherein the two-core cable forming the tagging part and the cable forming the connecting part are of the same quality.

4. An antitheft security tag according to claim 1, wherein one end of the connecting part to be connected to the article surveillance security system is provided with a connecting means detachably connectable to the article surveillance security system.

5. An article surveillance security system employing the antitheft security tag recited in claim 1.

6. An antitheft security tag to be used in combination with an article surveillance security system, said antitheft security tag comprising;

a tagging part to be tagged to an article, formed by looping a two-core cable having two distributed-resistance wires;

a connecting part formed out of a cable, to be connected to the article surveillance security system; and a joining part for joining the tagging part to the connecting part, wherein the free ends of the two distributed-resistance wires of said two-core cable are joined together in said joining part, and said foregoing components are connected so as to form a single electrical loop.

7. An antitheft security tag according to claim 6, wherein the cable forming the connecting part is a two-core cable.

8. An antitheft security tag according to claim 6, wherein the cable forming the connecting part is a two-core cable having two distributed-resistance wires.

9. An antitheft security tag according to claim 6, wherein the two distributed-resistance wires are carbon-fiber wires.

10. An antitheft security tag according to claim 6, wherein one end of the connecting part to be connected to the article surveillance security system is provided with a connecting means detachably connectable to the article surveillance security system.

11. An article surveillance security system employing the antitheft security tag recited in claim 6.

12. An antitheft security tag according to claim 6, wherein the two distributed-resistance wires are nickel-chrome alloy wires.

* * * * *

UNITED STATES PATENT AND TRADEMARK OFFICE

CERTIFICATE OF CORRECTION

PATENT NO. : 5,689,237

DATED : November 18, 1997

INVENTOR(S) : Shinichi Sasagawa et al.

It is certified that error appears in the above-indentified patent and that said Letters Patent is hereby corrected as shown below:

In the Title Page

In column 1, line 1, under "Foreign Application Priority Data", replace "Oct. 3, 1995" with --March 10, 1995--.

Signed and Sealed this

Fifth Day of October, 1999

*Attest:*

*Attesting Officer*

Q. TODD DICKINSON

*Acting Commissioner of Patents and Trademarks*